US005845514A

United States Patent [19]

Clarke et al.

[11] Patent Number: 5,845,514

[45] Date of Patent: Dec. 8, 1998

[54] CHILLING APPARATUS

[75] Inventors: Joseph Clarke, Clear Island Waters; Brian Forshaw, Victoria, both of Australia

[73] Assignee: Microchill International Limited, London, England

[21] Appl. No.: 875,637

[22] PCT Filed: Jan. 17, 1996

[86] PCT No.: PCT/AU96/00020

§ 371 Date: Jul. 16, 1997

§ 102(e) Date: Jul. 16, 1997

[87] PCT Pub. No.: WO96/22494

PCT Pub. Date: Jul. 25, 1996

[30] Foreign Application Priority Data

Jan. 17, 1995 [AU] Australia ..... PN0562

[51] Int. Cl.[6] ..... F25D 17/02

[52] U.S. Cl. ..... 62/373; 62/457.4; 62/457.9; 62/438

[58] Field of Search ..... 62/457.1, 457.2, 62/457.4, 457.5, 457.9, 430, 438, 376, 435, 433, 373

[56] References Cited

U.S. PATENT DOCUMENTS

| | | | |
|---|---|---|---|
| 2,061,427 | 11/1936 | King . | |
| 5,237,835 | 8/1993 | Brochier | 62/376 |
| 5,557,943 | 9/1996 | Coelho | 62/376 |

*Primary Examiner*—John M. Sollecito
*Attorney, Agent, or Firm*—St.Onge Steward Johnston & Reens LLC

[57] ABSTRACT

An apparatus for chilling beverage containers such as bottles or cans, includes a chamber which containing chilling liquid cooled by a refrigeration unit and a support arrangement for sup-porting containers in the liquid. A flexible membrane in the form of a plastics bag surrounds the containers to prevent the containers coming into direct contact with the liquid but which permits the chilling liquid to cool the contents of the containers. The support extends downward within the flexible membrane supporting the article therein and allowing thermal contact between the article and chilling liquid via the flexible membrane. The support is radially collapsible or flexible to facilitate improved thermal contact between the article and chilling liquid via the flexible membrane.

13 Claims, 3 Drawing Sheets

CHILLING APPARATUS

TECHNICAL FIELD

This invention relates to cooling or chilling apparatus which in a particular but not exclusive aspect, may be applied to the chilling of beverages in containers such as beer, wine and soft drinks in bottles or cans but which may be applied to cooling or chilling other articles.

BACKGROUND ART

Beverages in containers are normally cooled in conventional refrigerators, or in larger commercial establishments, cold rooms. There is, however, usually a considerable period of time which elapses between the time at which the beverage container is placed into a refrigerator or cold room and the time at which its temperature is acceptable for drinking. More rapid cooling can be achieved by using ice, however, ice is not readily available in many situations and additionally cannot be contained easily without melting. The above problems are accentuated in establishments which are involved in the supply of cold beverages such as restaurants. In these situations, it is often impossible for a large range of wines or other beverages to be stored and maintained at a low temperature for service and supply. Some arrangements have been proposed whereby bottles or other containers are placed into a container carrying a chilled liquid, however, in these arrangements the bottles or other containers become wet and therefore are not immediately suitable for use. Additionally, there is a danger that wet bottles or containers can slip from the grasp of a user.

SUMMARY OF THE INVENTION

The present invention aims to provide in a preferred aspect, apparatus for cooling or chilling beverages and in particular beverage containers such as wine bottles, beer and soft drink bottles, cans or the like, and the contents thereof, in a rapid and efficient manner whilst maintaining the beverage containers substantially dry. The present invention whilst particularly applicable to the cooling or chilling of beverages may be used for cooling or chilling of other articles. Other objects and advantages of the invention will become apparent from the following description.

With the above and other objects in view the present invention provides apparatus for cooling or chilling articles such as beverage containers and the contents thereof, said apparatus comprising a chamber for holding a cooling or chilling liquid, means for supporting a said article within said chamber, and flexible membrane means adapted to be disposed about a said article supported on said supporting means, said supporting means being radially collapsible to permit said flexible membrane means to contact a substantial portion of the periphery of said article whereby said article may be subject to the cooling or chilling effect of said liquid but prevented from direct contact with said cooling or chilling liquid.

Preferably the supporting means includes frame means which support the articles so that a major portion thereof is below the level of the cooling or chilling liquid in the chamber. The flexible membrane means is associated with or arranged adjacent the frame means. The pressure of the chilling liquid within the chamber causes the frame means to be radially inwardly deformed to permit the impervious bag to come into contact with the article so that the cooling or chilling effect of the liquid is transferred through heat exchange to the article. The flexible membrane means preferably comprises a bag formed of flexible liquid impervious material, for example a plastics bag which may be located externally of the framework. The bag suitably has its upper end or mouth supported above the level of liquid in the chamber.

The chamber preferably has a top wall provided with one or more openings into which respective articles to be chilled may be inserted. Associated with the or each opening is a respective frame means for supporting respective articles to be chilled. The top wall preferably includes an annular skirt arranged coaxially about each opening and about which a mouth of a bag may be secured such as by a resilient strip, band or other member or alternative fixing means.

Where the supporting means is surrounded by a bag, the bag is held by the supporting means in a generally open attitude and therefore prevented from being damaged as the article is moved into and out of the frame means.

The frame means suitably includes a base member upon which the article to be cooled seats directly or indirectly. The frame means further may include flexible side frame members which are inwardly deformable under the pressure of the liquid to permit the bag to contact a substantial portion of the periphery of the article supported by the frame means. The side frame members and base member may be defined by a member of substantially U-shaped form. The side frame members and base member may be formed integrally of a thin flexible or resilient material such as a strip or rod suitably of plastics material.

Preferably the cooling or chilling liquid is maintained at a low temperature by means of a refrigeration unit which includes, within the chamber, cooling coils, the coils being in contact with the liquid so that the liquid is subject to the direct cooling effect of the coils. The coils are suitably located adjacent to the walls of the chamber. Preferably, circulating means suitably in the form of a circulating pump are provided for circulating the cooling or chilling liquid within the chamber.

In order to prevent excessive heating of liquid in the chamber, an insulating material is preferably disposed about the chamber so that the liquid therein is substantially insulated from external temperatures.

The cooling liquid preferably comprises a glycol solution, preferably a propylene glycol solution. Suitably the solution comprises water and food quality propylene glycol.

BRIEF DESCRIPTION OF THE DRAWINGS

Reference will now be made to the accompanying drawings which illustrate a preferred embodiment of the invention and wherein.

DETAILED DESCRIPTION OF THE PREFERRED EMBODIMENT

Figure 2:
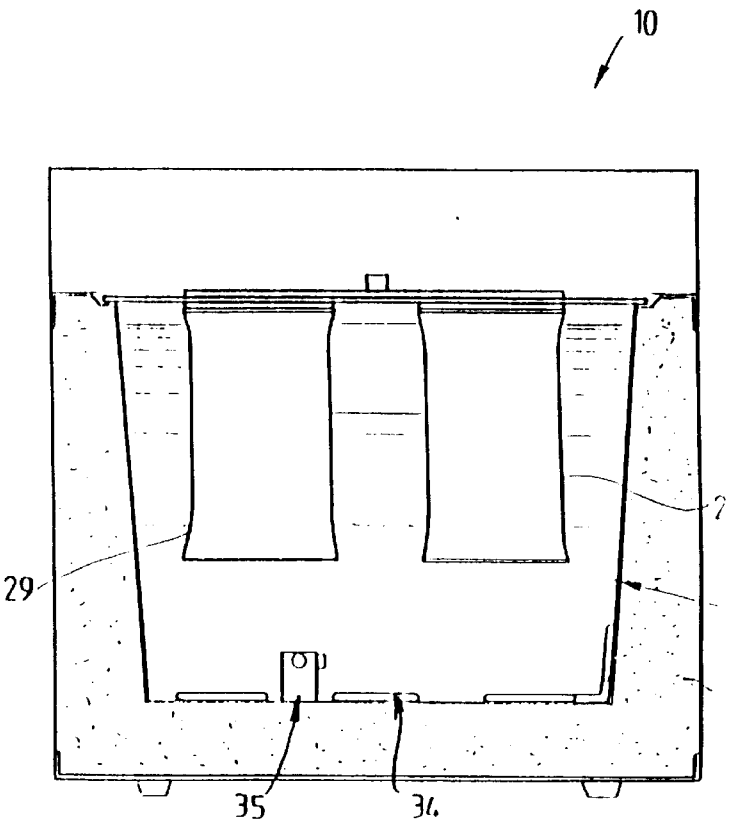
FIG. 2 is a sectional end-elevational view of the chamber of the apparatus of FIG. 1 with the bottle removed.
Figure 1:
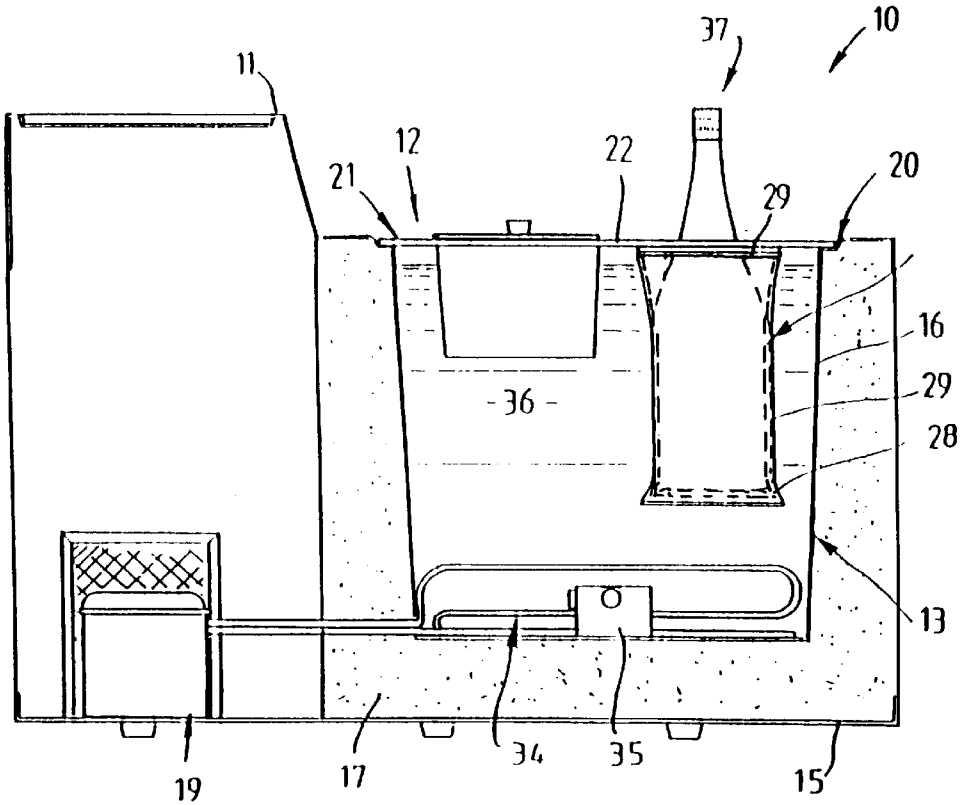
FIG. 1 is a sectional side-elevational view of the apparatus according to one form of the present invention showing a bottle being cooled or chilled.

Referring to the drawings and firstly to FIGS. 1 and 2 there is illustrated cooling or chilling apparatus 10 according to one form or the present invention including an external casing 11 surrounding an inner chamber assembly 12 which defines a hollow chamber 13 adapted to contain a liquid. Preferably, the chamber 13 and portion of the external casing 11 are formed of glass reinforced plastics (GRP) supported on an external metal base 15. The chamber 13 includes outwardly flared side walls 16 and is surrounded by an insulating material 17 such as a plastics foam which fills the space between the side walls 16 and at least portion of the casing 11 and base 15. The casing 11 also defines adjacent the chamber 13 a space 18 for a motor and compressor of a refrigeration unit 19.

Figure 3:
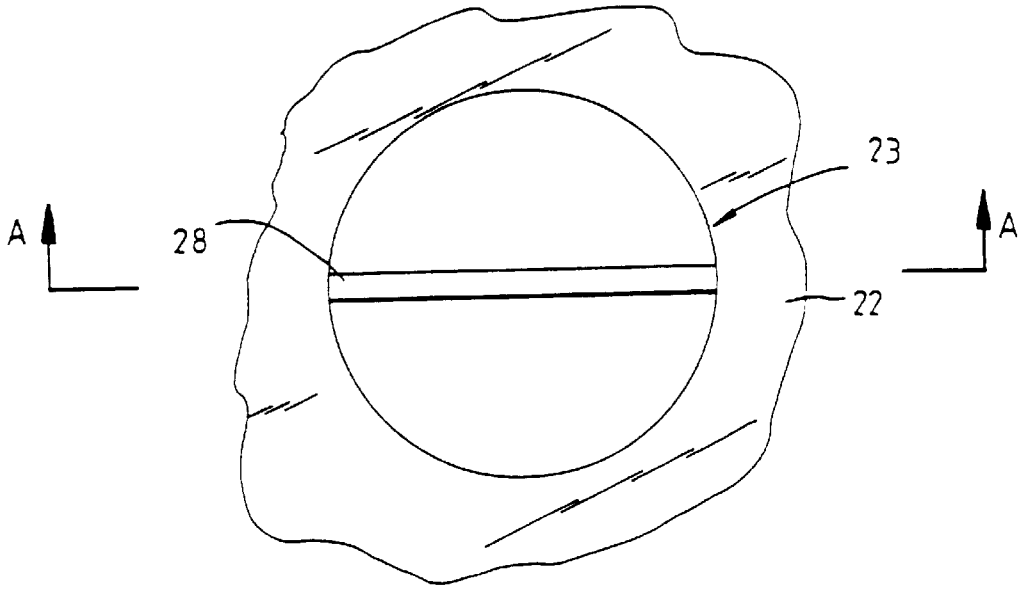
FIG. 3 is a plan view of one form of container supporting means for the apparatus of FIGS. 1 and 2.
Figure 4:
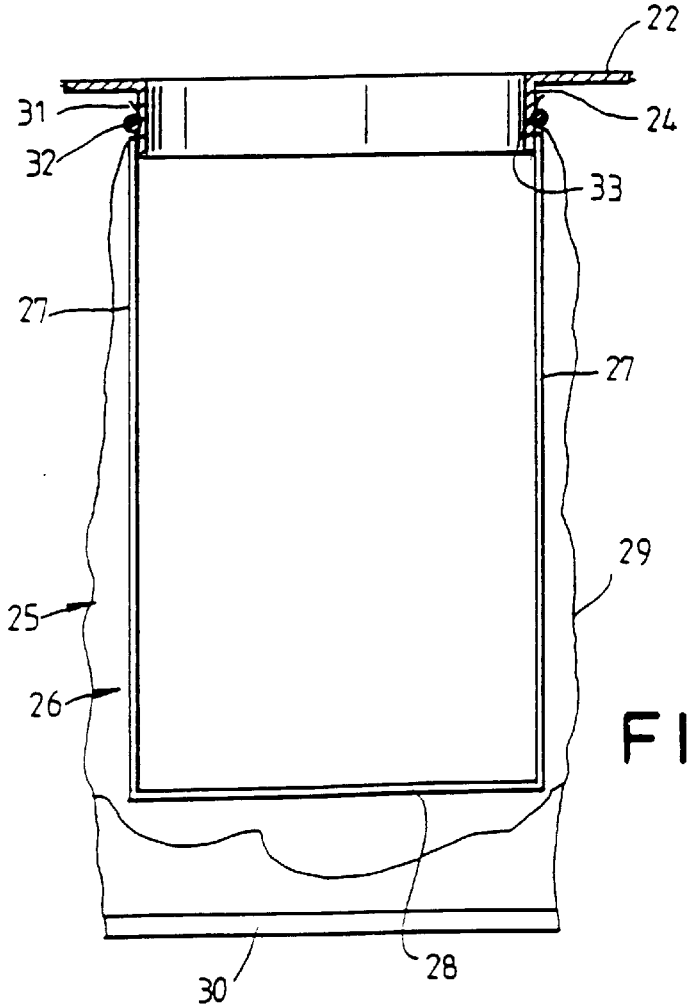
FIG. 4 is a sectional elevational view along line A—A of FIG. 3.

Defined in the chamber walls 16 is an upper ledge 20 about the upper periphery of the chamber 13 which is adapted to receive a top cover or wall assembly 21 which substantially closes the top of the chamber 13. The cover assembly 21 includes as more clearly shown in FIGS. 3 and 4, a top plate 22 provided with a number of openings 23, in this instance two, into which respective bottles to be chilled may be inserted. The underside of the plate 22 about each opening 23 is provided with a downwardly extending annular skirt 24 coaxial with the opening 23. Also extending to the underside of the plate 22 is an article support 25 which in this embodiment comprises a U-shaped member 26. The member 26 has a pair of opposite side arms 27 and a cross arm 28 joining the side arms 27 which forms a base upon which a container or other article may be seated. The member 26 is secured to the skirt 24, for example by adhesives or fasteners. For this purpose the upper ends of the side arms 27 are secured to the other side of the skirt 24, although they may be secured to the inner side thereof, by adhesives or other connected means. The U-shaped member 26 is preferably a thin flexible or resilient strip plastics material. Surrounding the member 26 is a bag 29 of thin liquid impervious plastics film or material which is closed and sealed at its base 30 and which has its upper end or mouth 31 located about the skirt 24. A rubber band or strip 32 is provided to hold the mouth 31 of the bag 29 to the skirt 24 above the arms 27 of the member 26. If desired the skirt 24 may incorporate an annular groove 33 or rib to receive or locate the band 32 to more securely hold the bag 29 in position.

Refrigeration coils 34 are provided in the lower portion of the chamber 13 adjacent to the walls and/or base thereof and extending out of the chamber 14 to communicate with the refrigeration unit 19. A circulation pump 35 may be mounted in the chamber 13 to circulate the cooling or chilling liquid within the chamber 13.

Figure 6:
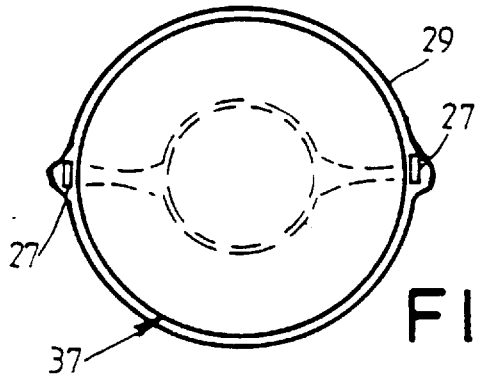
FIG. 6 is a sectional view along line B—B of FIG. 5.
Figure 5:
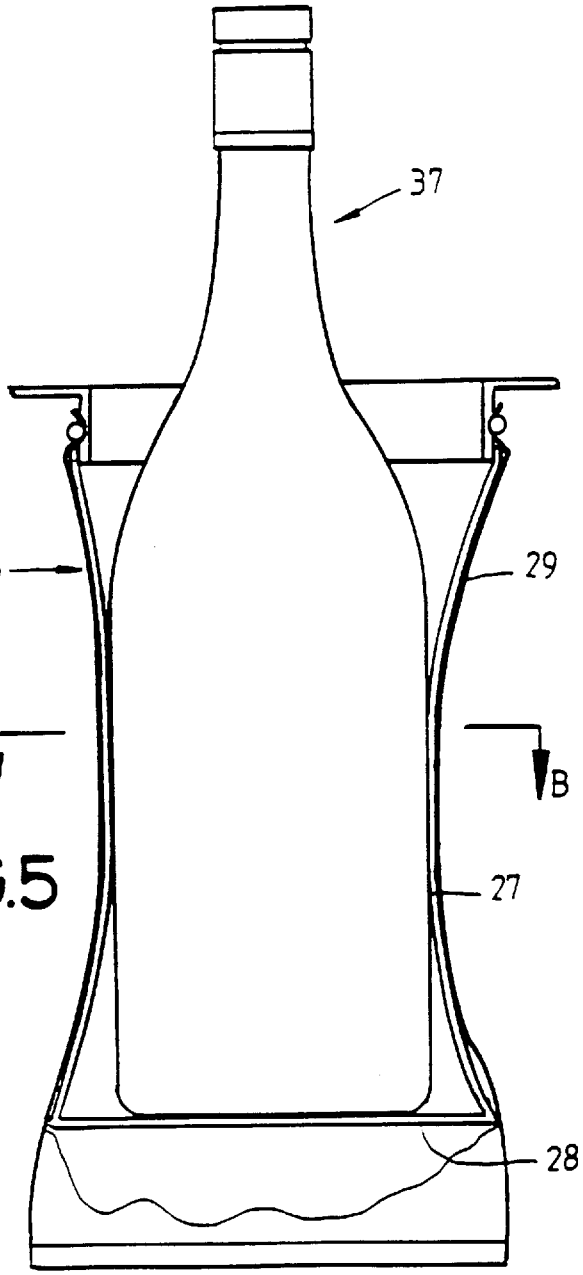
FIG. 5 is a part sectional elevational view illustrating the manner in which a bottle is supported and cooled in the apparatus.

In use, the chamber 13 is filled with a chilling liquid 36 up to the level indicated so that the bag 29 is substantially immersed. The pressure of the liquid 36 will tend to collapse the bag 29, and force the arms 27 of the member 26 inwardly, the member 26 being sufficiently flexible to permit this to occur. The chilling liquid 36 preferably comprises a low freezing point liquid and most preferably a solution containing food quality glycol. The solution is preferably a solution of propylene glycol and water of 50% concentration. The refrigeration unit 19 is operated so that through heat exchange between the coils 34 and liquid 36, the liquid 36 is rapidly cooled until a temperature below freezing is achieved. Preferably the temperature is in the range of −20 to −28 degrees Centigrade. A bottle 37 or other container to be chilled or cooled is placed into one of the openings 23 until it seats upon the lower cross arm 28 of the member 26 to be supported in an upstanding attitude as shown in FIGS. 1 and 5. During insertion, the bottle 37 forces the arms 27 apart to allow the bottle 37 to seat on the cross arm 28. The pressure of the liquid 36 upon the bag 29 will force the bag 29 into contact a substantial portion of the peripheral wall of the bottle 37 as shown in FIGS. 5 and 6 so that the contents thereof are rapidly chilled through heat exchange. Collapse of the bag 29 into engagement with the bottle 36 will also be facilitated due to the flexible nature of the member 26 and its arms 27 which are also forced inwardly by the pressure extended by the liquid on the bag 29 such as to allow maximum surface area of the bottle 37 to be contacted by the bag 29. This will enhance the heat exchange effect. The liquid impervious nature of the bag 29 however, prevents direct contact between the chilling liquid 36 and the bottle 37 so that the bottle remains dry. After a predetermined time the bottle 37 may be removed and is available for immediate use, the contents having been cooled to the desired temperature. The chilling liquid 36 also chills the container 31 which may be used for storage of ice or for maintaining other products in a cool or chilled state.

The member 26 supports the bottle 37 to be cooled independently of the bag 29 and thus the bag 29 is not subject to any direct loading from the bottles 37. Thus, there is little risk of the bag 29 being ruptured. Additionally, the member 26 prevents a vacuum being created between the bag 29 and that bottle 37 permitting the bottle 37 to be easily withdrawn from the chamber 13 with the bag 29 being restrained within the chamber 13 by the member 26. The lower ends of the frame members may also support or be connected to, a platform on which the bottles may be seated rather than the cross arm 28 illustrated.

It will be apparent in the arrangement described above that many different types of containers may be supported and cooled including cans which for example may be stacked one above the other. It will be further apparent that the retrieval of cans will not subject the users hands to the direct chilling effect of the liquid.

It will be appreciated that the configuration of the apparatus 10 may be substantially varied from the arrangement illustrated and described. The bags 29 may be of many different shapes and materials and comprise interconnected or moulded membranes or panels which will prevent liquid contact between the chilling liquid and bottle or other container or article to be cooled. The preferred material for the bags 29 is polythene of 50 to 100 microns thickness however other liquid impervious plastics may be used for the bags. A further alternative material for the bag comprises a plastics reinforced with nylon.

Of course the upper end of the bag or membrane may be secured to the top plate 22 about an opening 23 in any suitable fashion for example by means of fasteners, clamps or adhesives.

The U-shaped support 25 is most preferably a flexible or resilient U-shaped member 26 of strip or rod material but may be of other forms which will collapse inwardly to ensure substantial contact between the bag and the container or containers to be chilled. The arrangement described also permits a large range of containers or articles of many different sizes and shapes to be chilled as the support permits a the majority of the periphery of the containers to be contacted by the bag for efficient heat exchange. This is apparent in FIG. 6 which shows in dotted outline a smaller container encompassed substantially by the bag 29.

Whilst the above has been given by way of illustrative embodiment of the invention, all such modifications and variations thereto as would be apparent to persons skilled in the art are deemed to fall within the broad scope and ambit of the invention as herein defined in the appended claims.

We claim:

1. Apparatus for chilling articles such as beverage containers an d the content s thereof, the apparatus including:

chamber for holding a chilling liquid;

flexible membrane means extending downwardly into the chamber and having an open upper end or mouth f or receiving the article; and supporting means extending downwardly within the flexible membrane means for supporting the article within the flexible membrane means and allowing thermal contact between the article and chilling liquid via the flexible membrane means;

wherein the supporting means is radially collapsible or flexible to facilitate improved thermal contact between the article and chilling liquid via the flexible membrane means.

2. Apparatus according to claim 1 wherein the supporting means includes frame means for supporting the article so that a major portion thereof is arranged below the level of the chilling liquid in the chamber.

3. Apparatus according to claim 2 wherein the flexible membrane means surrounds the frame means and hydrostatic pressure on the exterior of the flexible membrane means causes the flexible membrane means to contact the article through gaps in the frame means.

4. Apparatus according to claim 1 wherein the flexible membrane means comprises a bag formed of liquid impervious material.

5. Apparatus according to claim 4 wherein the bag has its upper end or mouth supported above the level of liquid in the chamber.

6. Apparatus according to claim 1 wherein the chamber has a top wall provided with one or more openings for receipt of articles to be chilled.

7. Apparatus according to claim 6 wherein the top wall includes an annular skirt associated with each opening about which a mouth of a flexible membrane means may be secured.

8. Apparatus according to claim 7 wherein the flexible membrane means mouth is secured about the skirt by means of a resilient member.

9. Apparatus according to claim 2 or 3 wherein the frame means includes a base member upon which the article may seat.

10. Apparatus according to claim 9 wherein the frame means includes side frame members supporting the base member, the side frame members being flexible to allow for radial inward deformation thereof.

11. Apparatus according to claim 10 wherein the side frame members and base member are defined by a member of substantially U-shaped form.

12. Apparatus according to claim 10 wherein the base member and side frame members are formed integrally of a flexible plastics material.

13. Apparatus according to claim 12 wherein the flexible plastics material comprises a flexible strip.

* * * * *